United States Patent [19]

Yoshida

[11] Patent Number: 4,728,094

[45] Date of Patent: Mar. 1, 1988

[54] ARRANGEMENT FOR SETTING A PAPER FEEDING CASSETTE

[75] Inventor: Takeshi Yoshida, Yamatokoriyama, Japan

[73] Assignee: Sharp Kabushiki Kaisha, Osaka, Japan

[21] Appl. No.: 816,060

[22] Filed: Jan. 3, 1986

[30] Foreign Application Priority Data

Jan. 8, 1985 [JP] Japan ..... 60-1329[U]
Jan. 8, 1985 [JP] Japan ..... 60-1330[U]
Jan. 25, 1985 [JP] Japan ..... 60-9700[U]

[51] Int. Cl.[4] ..... B65H 3/06; B65H 1/08

[52] U.S. Cl. ..... 271/119; 271/127; 271/164; 355/14 SH

[58] Field of Search ..... 271/126, 127, 145, 160, 271/170, 171, 162, 164, 119; 221/198, 231; 355/72, 14 SH, 3 SH

[56] References Cited

U.S. PATENT DOCUMENTS 3,689,064 9/1972 Kuksa ..... 271/127
4,307,878 12/1981 Kono ..... 271/127
4,350,328 9/1982 Katakura et al. ..... 271/127 X
4,487,406 12/1984 Kabashima ..... 271/127
4,535,982 8/1985 Mochimaru ..... 271/162 X
4,540,169 9/1985 Levinson ..... 271/127
4,623,137 11/1986 Irie et al. ..... 271/127 X

*Primary Examiner*—Joseph J. Rolla
*Assistant Examiner*—Gregory L. Huson
*Attorney, Agent, or Firm*—Birch, Stewart, Kolasch & Birch

[57] ABSTRACT

A paper feeding cassette setting arrangement which is so arranged that the action point of a pushing arm is pulled by a spring so as to push up a paper tray only when the paper feeding cassette is set in the copying apparatus. The operator has only to push in the paper feeding cassette when the cassette is desired to be set in the copying apparatus, and also the operator has only to pull out the paper feeding cassette when the cassette is desired to be taken out of the copying apparatus since the cassette has been already pulled out to some extent, with the lock thereof being released. A pushing arm may rotate orthogonal to the paper feeding direction.

6 Claims, 10 Drawing Figures

ARRANGEMENT FOR SETTING A PAPER FEEDING CASSETTE

BACKGROUND OF THE INVENTION

The present invention generally relates to an arrangement for setting a copy paper feeding cassette into a paper feeding part of a copying apparatus or the like.

Generally, for feeding out copy papers by a paper feeding roller in the paper feeding part of a copying machine, etc., such an arrangement is required that can push upwards copy papers accommodated in the copy paper cassette. Therefore, in a prior art copying machine, a lever-like pushing arm is provided in the copy paper feeding part, and it is so arranged that a point of action of the pushing arm pushes upwards the rear face of a paper tray loading copy papers thereon within the paper feeding cassette. However, in the prior art cassette setting arrangement, since the pushing arm is always stretched by a spring so as to push up the paper tray, when the paper feeding cassette is to be taken out of the copying machine, it should be done after the pushing arm is pressed down by a lever or the like. Therefore, it is inconvenient that the prior art arrangement needs complicated operation for setting or taking the paper feeding cassette in or out of the copying machine. Moreover, since the operation for moving the lever or the like requires considerable work, it may be a trouble to the operator of the copying machine, particularly, to an operator of the copying machine.

SUMMARY OF THE INVENTION

Accordingly, an essential object of the present invention is to provide an improved arrangement for setting or taking a paper feeding cassette in or out of an apparatus, which is so designed that a spring is pulled back to lower a point of action of a pushing arm when the paper feeding cassette is withdrawn, thereby realizing easy removal of the paper feeding cassette.

Another object of the present invention is to provide an improved arrangement of the type referred to above for setting or taking a paper feeding cassette in or out of an apparatus, which is so constructed that the paper feeding cassette is withdrawn by a spring, when the paper feeding cassette is released from the lock by a lock device, so as to lower a point of action of a pushing arm, thereby realizing easy removal of the paper feeding cassette.

A further object of the present invention is to provide an improved arrangement of the type referred to above for setting or taking a paper feeding cassette in or out of an apparatus, in which the paper feeding cassette is set in or taken out of the apparatus in the direction orthogonal to the paper feeding direction, and at the same time a paper holder tray for loading copy papers thereon within the cassette is pushed up in the same direction as that in which the paper feeding cassette is set or taken out of the apparatus, thereby realizing a stable pushing-up of the paper holder tray.

In accomplishing these and other objects, according to one preferred embodiment of the present invention, an arrangement for setting a paper feeding cassette in an apparatus comprises a lever-like pushing arm having a fulcrum thereof pivotally supported at a paper feeding part and a point of action thereof to push up a paper feeding cassette set in the paper feeding part, a spring, one end of which is secured to a dynamic point of said pushing arm, a sliding plate which is brought into partial contact with said paper feeding cassette, when the cassette is set in the paper feeding part, so as to slide in accordance with the movement of said cassette, the other end of said spring being secured to said sliding plate, and a lock device for securing said paper feeding cassette to said paper feeding part.

In the paper feeding cassette setting arrangement having the construction as described above, when the paper feeding cassette is not set in the apparatus, the spring is in the free state, without pushing the dynamic point of the pushing arm, and accordingly with lowering the action point of the pushing arm. In the case where the paper feeding cassette is to be set in the apparatus, the sliding plate is pressed to pull one end of the spring and also the dynamic point of the pushing arm at the other end of the spring. Therefore, the action point of the pushing arm is raised so as to push up the paper holder tray in the paper feeding cassette. When the paper feeding cassette is pushed into a predetermined position, the cassette is locked by the lock device. On the other hand, in the case where the paper feeding cassette is to be taken out of the apparatus, the lock by the lock device should be released. At this time, when the lock is released, the sliding plate is pulled back to withdraw the paper feeding cassette to some extent. Since the spring is returned to its free state when the paper feeding cassette is withdrawn, the dynamic point of the pushing arm comes not to be pulled, lowering the action point thereof. Therefore, the paper feeding cassette can be pulled out further by hands, without being hooked by the action point of the pushing arm, and finally taken out of the apparatus. Thus, according to the arrangement of the present invention, no manipulation of a heavy lever or the like for taking out the paper feeding cassette is necessary. The paper feeding cassette is pulled out to some extent only by releasing the lock, and thereafter, it can be easily set in or taken out of the apparatus, with no troublesome operation therefor.

BRIEF DESCRIPTION OF THE DRAWINGS

These and other objects and features of the present invention will become apparent from the following description taken in conjunction with the preferred embodiments thereof with reference to the accompanying drawings, in which.

Before the description of the present invention proceeds, it is to be noted here that like parts are designated by like reference numerals throughout the accompanying drawings.

DETAILED DESCRIPTION OF THE INVENTION

Hereinafter, the arrangement for setting the paper feeding cassette according to the present invention will be described with reference to the case where it is put into use in a paper feeding part of a copying apparatus.

EXAMPLE 1

Figure 1:
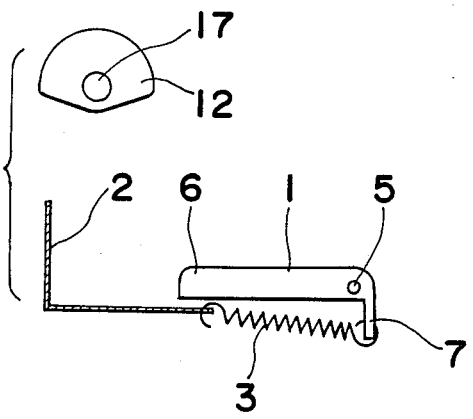
FIG. 1 is a schematic side elevational view of an arrangement for setting a paper feeding cassette into a paper feeding part of a copying apparatus according to a first embodiment of the present invention.
Figure 2:
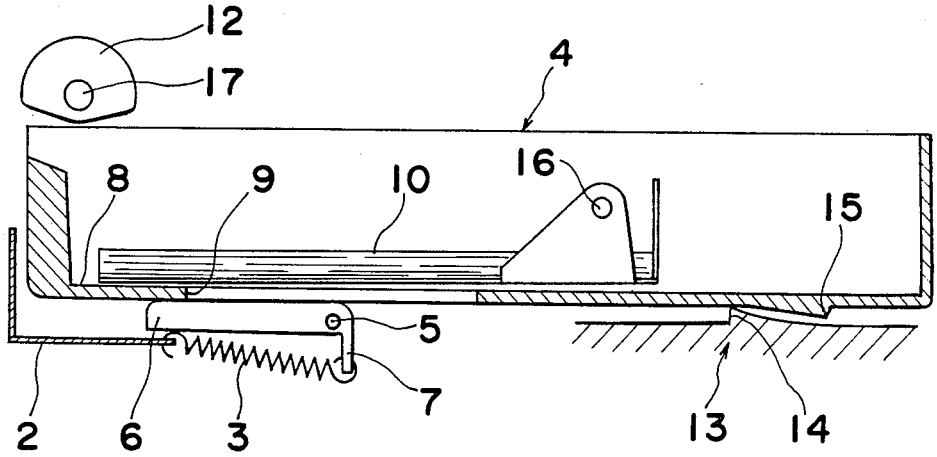
FIG. 2 is a schematic side elevational view of the arrangement of FIG. 1, illustrative of the condition before the paper feeding cassette is set into the paper feeding part.

Referring now to FIG. 1, there is shown a schematic side elevational view of an arrangement for setting a paper feeding cassette into a paper feeding part of a copying apparatus according to a first embodiment of the present invention. The arrangement comprises a pushing arm 1, a sliding plate 2, a spring 3 and a lock device 13, all provided in the paper feeding part of the copying apparatus. The pushing arm 1 in the form of a lever has one fixed end 5 serving as a fulcrum thereof pivotally supported below the part where a paper feeding cassette 4 is set in the paper feeding part of the copying apparatus, and the other end 6 extending in the direction in which copy papers are fed, so as to form a point of action thereof. A dynamic point 7 of the pushing arm 1 is found at an end portion of the arm 1 protruding downwards from the fulcrum 5. The sliding plate 2 having an L-shaped cross section is slidably provided by a known guide member (not shown) in the rear and front of the paper feeding direction, with one end portion thereof standing upright with respect to the pushing arm 1 at the side of the paper feeding direction. The spring 3 has one end thereof secured to the dynamic point 7 of the pushing arm 1, and the other end thereof secured to the distal end of the other end portion of the sliding plate 2. A hook piece 14 in a claw shape provided backwards of the paper feeding direction of the paper feeding part and a hook piece 15 of the same shape as that of the hook piece 14 provided backwards of the paper feeding direction of the paper feeding cassette 4 constitute the lock device 13. The hook piece 14 of the paper feeding part is formed upwards and towards the paper feeding direction, while the hook piece 15 of the paper feeding cassette 4 is formed downwards and towards the direction opposite to the paper feeding direction.

The paper feeding cassette 4 has an opening 9 located at the center of the bottom plat of a boxlike outer frame 8, through which the action point 6 of the pushing arm 1 comes in the paper feeding cassette 4. Rear ends of copy papers 10 with respect to the paper feeding direction are slidably supported by a fixed fulcrum 16 within the outer frame 8, while the front ends thereof are mounted on a paper holder tray 11 swinging upwards and downwards.

Figure 3:
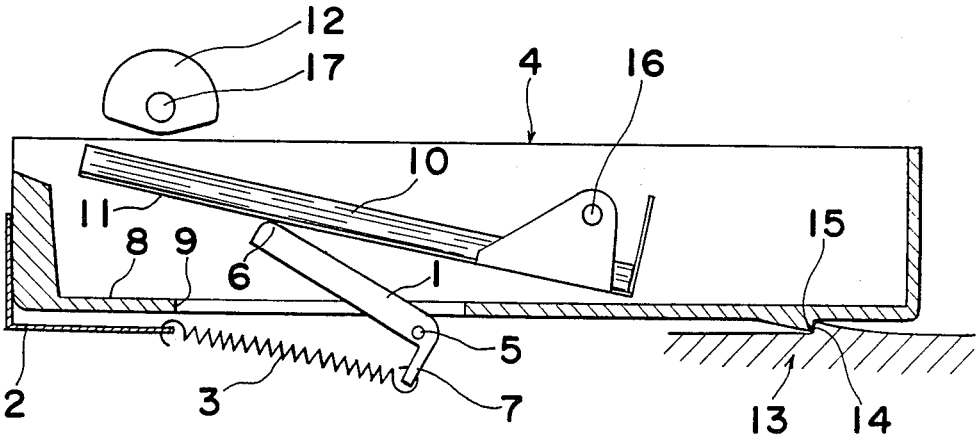
FIG. 3 is a schematic side elevational view of the arrangement of FIG. 1, illustrative of the condition after the paper feeding cassette is set into the paper feeding part.

In the cassette setting arrangement having the aforementioned construction according to the first embodiment of the present invention, in the case where the paper feeding cassette 4 is not set in the paper feeding part, the sliding part 2 is placed a predetermined position and the spring 3 is in a free state. Therefore, the dynamic point 7 of the pushing arm 1 is not pulled, with the action point 6 being flush with respect to the fulcrum 5. Meanwhile, when the paper feeding cassette 4 is set in the paper feeding part of the copying apparatus, the inner surface of the standing one end portion of the sliding plate 2 is pressed into contact against the end portion of the outer frame 8 of the paper feeding cassette 4 towards the paper feeding direction, as shown in FIG. 3. Accordingly, the spring 3 is stretched to pull the dynamic point 7, thereby raising the action point 6 which in turn protrudes out of the opening 9 and presses the rear face of the paper tray 11. Then, the end portion of the paper tray 11 in the paper feeding direction is raised to displace the end portions of the copy papers 10 mounted on the paper tray 11 below a paper feeding roller 12 fixed to a main shaft 17. The copy papers 10 are accordingly sent out one by one in consequence of the rotational movement of the half-moon feeding roller 12. Moreover, at this time, since the hook piece 15 of the paper feeding cassette 4 is engaged with the hook piece 14 of the paper feeding part, the movement of the paper feeding cassette rearwards of the paper feeding cassette rearwards of the paper feeding direction is restricted and accordingly, the paper feeding cassette 4 is stopped at the proper position for setting, without being forcibly pushed back by the spring 3. On the other hand, in the case where the paper feeding cassette 4 is to be taken out of the copying apparatus, first, the backward end portion of the paper feeding cassette 4 in the paper feeding direction is slightly lifted so as to disengage the hook piece 15 from the hook piece 14 of the paper feeding part. Then, the paper feeding cassette 4 is released from the lock by the lock device 13, and pushed by the sliding plate 2 pulled by the spring 3 and withdrawn in the direction opposite to the paper feeding direction approximately until the spring 3 is returned to its free state. Further, owing to the above fact that the spring 3 is returned to its free state in accordance with the movement of the paper feeding cassette 4, the action point 6 of the pushing arm 1 falls down by its own weight. Therefore, an operator of the copying apparatus has only to take out, by hands, the cassette 4 which has already been pulled out to some extent. It is needless to say that there is no possibility that the action point 6 of the pushing arm 1 is caught by an edge of the opening 6 of the paper feeding cassette 4, which would obstruct the paper feeding cassette 4 to be taken out of the copying apparatus.

As is clear from the foregoing description, according to the paper feeding cassette setting arrangement of the first embodiment of the present invention, since it is so arranged that the action point 6 of the pushing arm 1 is pulled by the spring 3 so as to push up the paper tray 11 only when the paper feeding cassette 4 is set in the copying apparatus, the operator has only to push in the paper feeding cassette 4 when the cassette 4 is desired to be set in the copying apparatus, and also the operator has only to pull out the paper feeding cassette 4 when the cassette 4 is desired to be taken out of the copying apparatus since the cassette 4 has already been pulled out to some extent, with the lock thereof being released. It is not necessary to move a heavy lever or the like when the paper feeding cassette 4 is desired to be taken out of the copying apparatus. Therefore, even an operator having small strength can easily set and take out the paper feeding cassette 4.

EXAMPLE 2

Next, the paper feeding cassette setting arrangement according to the second embodiment of the present invention will be described with reference to the case where it is put into use in a paper feeding part of another copying apparatus.

Figure 4:
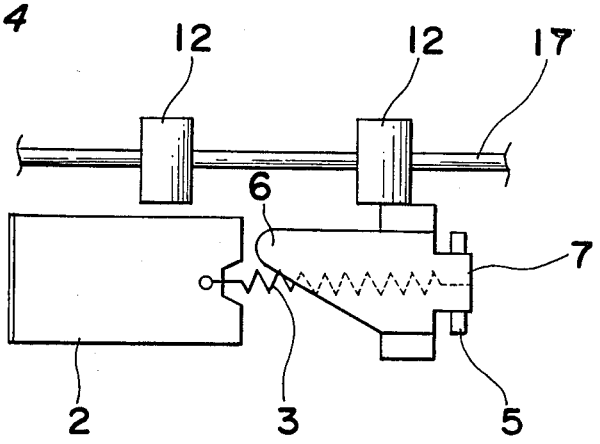
FIG. 4 is a schematic plan view of an arrangement for setting a paper feeding cassette into a paper feeding part of a copying apparatus according to a second embodiment of the present invention.

Referring to FIG. 4, there is shown a schematic plan view of a paper feeding cassette setting arrangement according to a second embodiment of the present invention.

Figure 5:
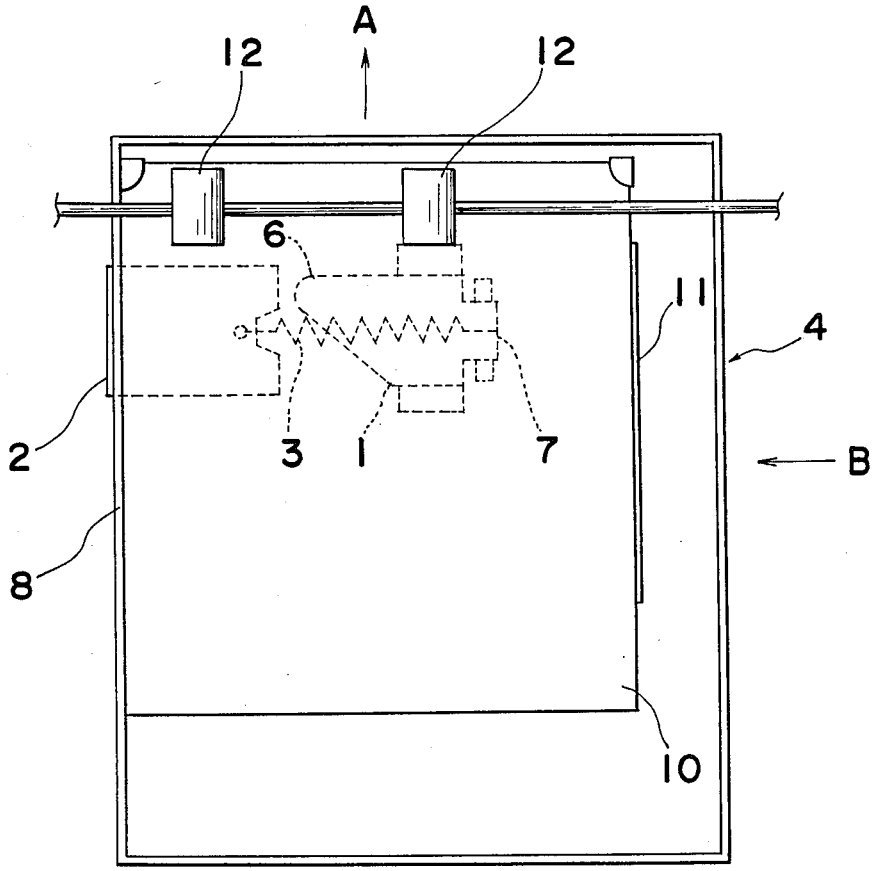
FIG. 5 is a schematic plan view of the arrangement of FIG. 4, illustrative of the condition before the paper feeding cassette is set into the paper feeding part.
Figure 6:
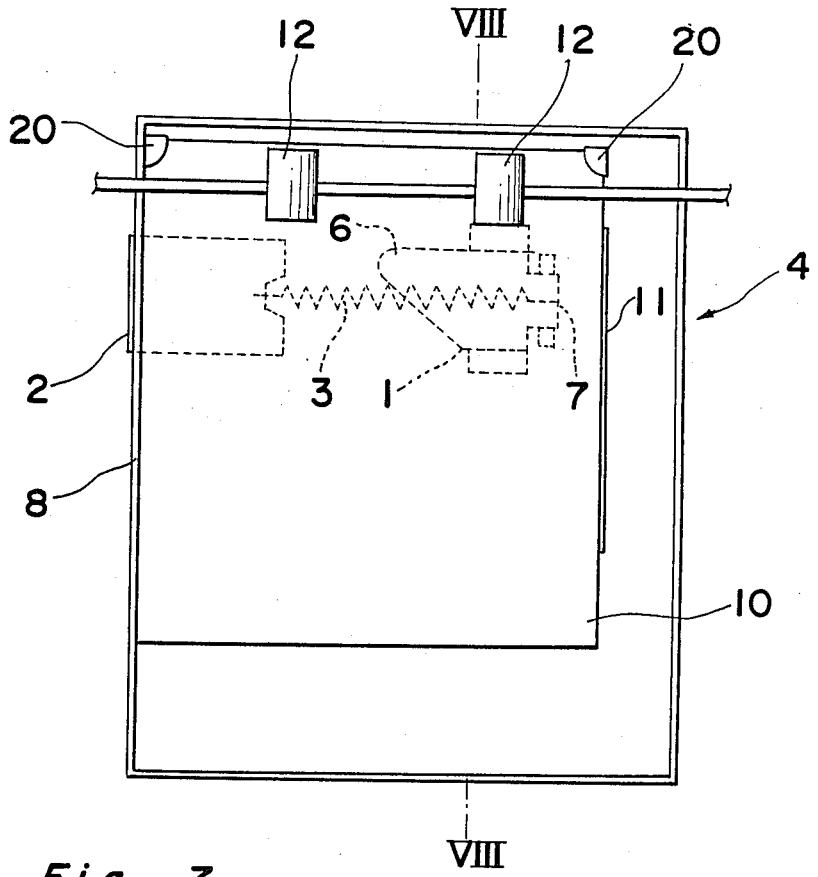
FIG. 6 is a schematic plan view of the arrangement of FIG. 4, illustrative of the condition after the paper feeding cassette is accommodated into the paper feeding part.

The arrangement shown in FIG. 4 is so arranged that a paper feeding cassette 4 is set into the paper feeding part of the copying apparatus in the transverse direction with respect to the paper feeding direction. As shown in FIG. 5, the sliding plate 2 is placed at the predetermined position and the spring 3 is in the free state just before the paper feeding cassette 4 is set in the paper feeding part. Therefore, the dynamic point 7 of the pushing arm 1 is not stretched by the spring 3 and the point of action 6 is not raised. Then, when the paper feeding cassette 4 is set, the inner surface of the standing one end portion of the sliding plate 2 is brought into pressed contact with the side end of the outer frame 8 to be pressed sidewards as shown in FIG. 6. As a result, the spring 3 is stretched to pull the dynamic point 7, thereby to raise the action point 6 to push the rear face of the paper tray 11. Subsequently, the distal end of the paper tray 11 in the paper feeding direction is raised such that end portions of the copy papers 10 mounted on the paper tray 11 are moved down below the paper feeding rollers 12. In accordance with the rotation of this half-moon feeding roller 12, the copy papers 10 are sent out one by one. At this time, the paper feeding cassette 4 is locked by the lock device 13 (not shown). Therefore, in the case where the paper feeding cassette 4 is to be taken out of the copying apparatus, the lock by the lock device 13 should be first released. Accordingly, the paper feeding cassette 4, while being pressed by the sliding plate 2 pulled by the spring 3, is taken out in the direction opposite to the direction in which the cassette 4 is set in the copying apparatus approximately until the spring 3 is returned back to the free state. In accordance with this movement of the cassette 4, the spring 3 is returned back to the free state, and therefore, the action point 6 of the pushing arm 1 is descended by its own weight. Consequently, the operator has only to take out the cassette which has already been pulled out to some extent, by hands and with ease. There is no possibility that the action point 6 of the pushing arm 1 is hooked by an edge of the opening 9 to obstruct the taking-out of the paper feeding cassette 4.

Thus, it is so arranged according to the arrangement of the second embodiment of the present invention that the action point 6 of the pushing arm 1 is pulled by the spring 3 so as to push up the paper tray 11 only when the paper feeding cassette 4 is set in the copying apparatus, and therefore, when the paper feeding cassette 4 is desired to be set in the copying apparatus, the operator has only to push the cassette 4 in the copying apparatus. When the paper feeding cassette 4 is desired to be taken out of the copying apparatus, the operator has only to take out the cassette 4 with ease, which has already been pulled out to some extent, achieving the same effect as in the first embodiment of the present invention referred to earlier.

It is to be noted here that although the description of the first and second embodiments is directed to the case where the arrangement is practiced in the paper feeding part of the copying apparatus, the arrangement can be employed in any type of apparatus so long as it supplies papers in the form of sheets one by one from a cassette accommodating the papers therein, with the same effect as in the foregoing embodiments.

EXAMPLE 3

Figure 8:
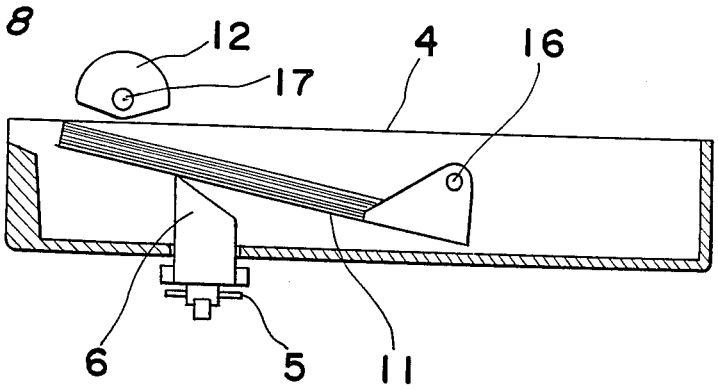
FIG. 8 is a cross sectional view taken along the line VIII—VIII of FIG. 6.

FIG. 8 is a cross sectional view taken along the line VIII—VIII of FIG. 6. In FIG. 8, the paper feeding cassette 4 has the paper tray 11 for loading copy papers 10 thereon rotatably supported by a shaft portion 16. The paper feeding cassette 4 has an opening 9 formed at the bottom thereof, corresponding to the pushing arm 6, such that the paper tray 11 is pushed up towards the paper feeding rollers 12 by the pushing arm 6. In order to always maintain the uppermost of the copy papers 10 mounted on the paper tray 11 at a given height, there is provided a claw 20, as shown in FIG. 6, on a guide panel which guides side portions of the copy papers 10. A pair of the claws 20 is provided at opposite corners of an end portion of the copy paper 10 in the same manner as in the prior art copying apparatus so as to separate the copy papers from each other.

Figure 7:
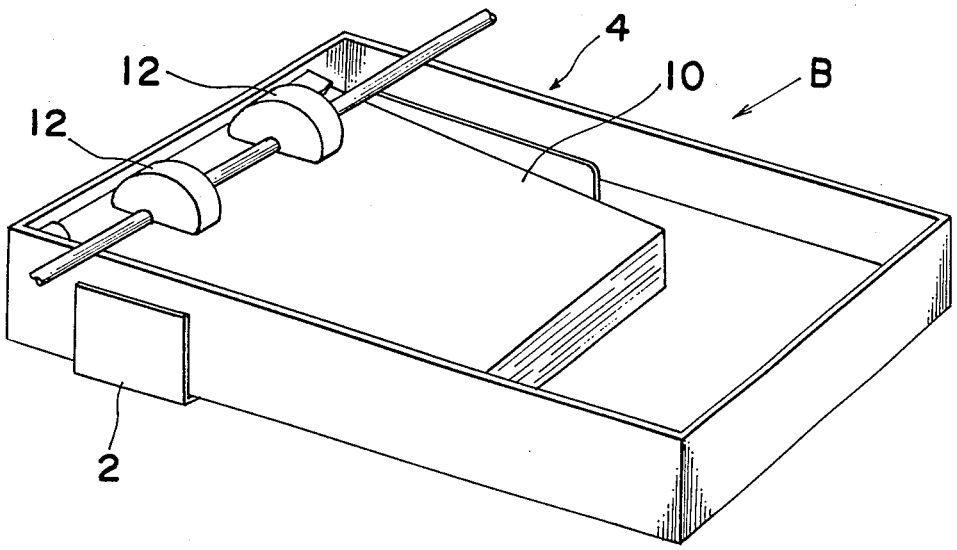
FIG. 7 is a perspective view of the arrangement of FIG. 6.

The paper feeding cassette 4 is set into the paper feeding part of the copying apparatus, as shown in FIG. 5, in the direction B crossing at right angles with respect to the paper feeding direction A. In FIG. 5, the pushing arm 6 constituting a push-up mechanism is rotated by a shaft 5 provided at the bottom portion of the paper feeding part along the direction in which the paper feeding cassette is accommodated in the copying apparatus. In other words, the direction of the movement of the paper tray 11 within the cassette 4 is crossed at right angles with respect to that of the rotational movement of the pushing arm 6. Further, as shown in FIG. 6, the sliding plate 2 for pressing the pushing arm 6, at the bottom portion of the paper feeding part in the direction in which the paper feeding cassette 4 is accommodated in or taken out of the copying apparatus. As shown in FIG. 7, this sliding plate 2 has an L-shaped cross-section so as to be engaged with the cassette 4 at one side thereof. Referring back to FIG. 6, one end of the sliding plate 2 is secured to one end of the spring 3. The other end of the spring 3 is secured to the other end portion 7 opposite to an action point 18 of the pushing arm 6. Namely, the pushing arm 6 is so constructed that when the spring 3 is actuated, the action point 18 is rotated around the shaft 5 upwards in the drawing. The spring 3 in the state of FIG. 5 permits the sliding plate 2 to slide to the predetermined position, that is, the spring 3 is in the free state in FIG. 5, and therefore, never pushing up the pushing arm 6.

The operation of the paper feeding device by the use of the paper feeding cassette having the construction as mentioned above will be described below. Supposing that it is immediately before the paper feeding cassette 4 is set in the copying apparatus, the sliding plate 2 is placed at the given position and the spring 3 is in the free state as shown in FIG. 5, and therefore, the end portion 7, i.e., the dynamic point of the pushing arm 6 is not pulled, with the point of action 18 being never raised. Next, when the paper feeding cassette 4 is set in the copying apparatus, as shown in FIG. 6, the inner side surface of the standing one end portion of the sliding plate 2 comes into contact with the side of the outer frame of the cassette 4 to be pressed sidewards. Accordingly, the spring 3 is stretched to pull the dynamic point 7 of the pushing arm 6, thereby raising the action point 18 to push up the rear face of the paper tray 11. Then, the end portion of the paper tray 11 in the paper feeding direction is raised around the shaft portion 19, and the distal end of the uppermost of the copy papers 10 on the paper tray 11 is lifted up to the claw 20 until it reaches below the feeding rollers 12. Thus, the copy papers 10 are subsequently supplied one by one in accordance with the rotation of the paper feeding rollers 12.

In the meantime, when the paper feeding cassette 4 is to be taken out of the copying apparatus, the sliding plate 2 is returned by the spring 3 in accordance with the movement of the cassette 4. Therefore, the spring 3 is brought into the free state, and at the same time the action point 18 of the pushing arm 6 falls down by its own weight. Thus, the action point 18 is never caught up by the paper feeding cassette 4, which would disturb the taking-out of the paper feeding cassette 4.

In the paper feeding device by the use of the paper feeding cassette 4 according to this embodiment of the present invention, the action point 18 of the pushing arm 6 is so arranged as to push the paper tray 11 up only when the paper feeding cassette 4 is set in the copying apparatus, and therefore, the paper feeding cassette 4 has only to be pushed in when it is desired to be set in the copying apparatus. On the other hand, when it is desired to be taken out of the copying apparatus, the paper feeding cassette 4 has only to be pulled outwards. Accordingly, in the arrangement of the present invention, it is convenient that the paper feeding cassette can be easily set in or taken out of the copying apparatus.

Figure 9:
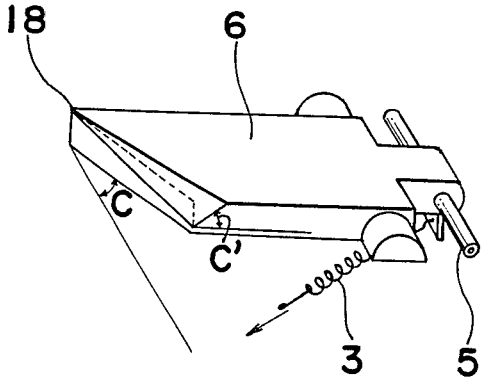
FIG. 9 is a perspective view of a pushing arm.
Figure 10:
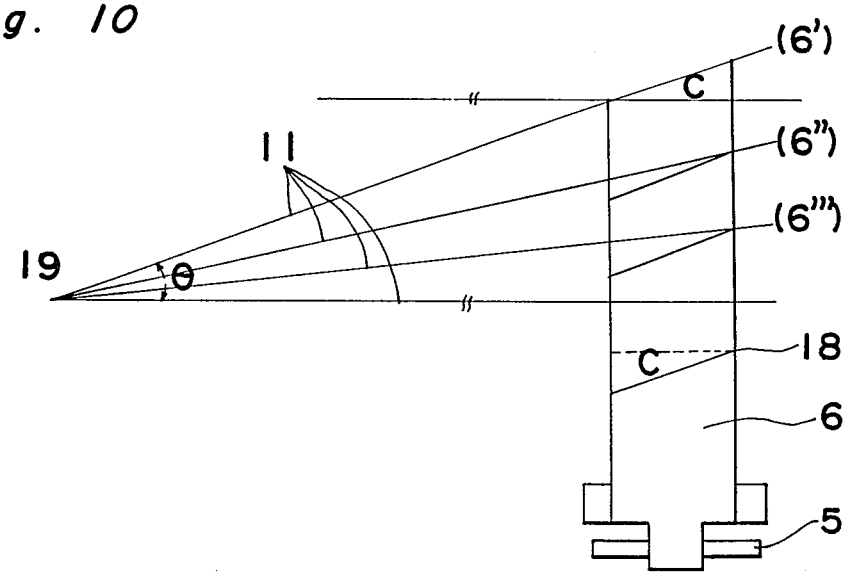
FIG. 10 is a side elevational view of the pushing arm, illustrative of the configuration thereof.

Furthermore, in the paper feeding device provided with the paper feeding cassette setting arrangement according to the present invention, the configuration of the pushing arm 6 is determined in the manner as shown in FIG. 10 for the purpose of securely and stably pushing up the paper tray 11 within the paper feeding cassette 4. In other words, the configuration of the pushing arm 6 is determined such that the action point 18 which is a contact point of the pushing arm 6 with the paper tray 11 is positioned farther than the shaft portion 16 of the paper tray 11. Accordingly, the pushing arm 6 has its end portion inclined so as to follow the rotational angle $\theta$ of the paper tray 11, as seen from FIG. 9, such that the action point 18 is found at the side of the paper feeding direction. The inclination angle C formed by the end portion of the pushing arm 6 is so determined that when the paper tray 11 reaches the highest position (in the 1 state), in other words, when the paper tray 11 is pushed up by the pushing arm 6 and brought into contact with the claw 20, without copy papers mounted thereof, the paper tray 11 at this time is in contact at least with the distal edge of the inclined pushing arm 6. That is, the inclination angle C is set to establish an equation $C=\theta$ or $C>\theta$, $\theta$ being the angle formed by the paper tray 11 when it reaches the highest position, and accordingly, the action point 18 of the pushing arm 6 is brought into contact with the paper tray 11 to push up the paper tray 11.

In the meantime, when the pushing arm 6 has a considerable thickness as shown in FIG. 9, and C is the same as $\theta$ or slightly larger than $\theta$, the action point 18 may possibly be moved to the side of the shaft portion of the paper tray 11. Therefore, with respect to the pushing arm 6 having the thickness d also, an end portion of the pushing arm 6 opposite to the action point 18 should be cut off such that an equation $\theta \leqq C'$ is established.

By forming the pushing arm 6 in the manner as described above, the action point 18 of the pushing arm 6 for pushing up the paper tray 11 is always positioned at the end side of the copy papers, and remote from the rotating part (shaft portion 16) of the paper tray 11. As a result, the paper tray 11 can be pushed up by the pushing arm 6 even with small force and moreover, copy papers can be always stably pushed up at the given position. However, if the action point of the pushing arm 6 comes near the rotating point of the paper tray 11, the force of the pushing arm 6 through the spring 3 for pushign up the paper tray 11 may be short, and copy papers which are accordingly found not at the predetermined position may be unable to be supplied by the feeding rollers 12. In view of this fact, according to the arrangement of the present invention, the action point 18 of the pushing arm 6 is arranged to be always at the side of the paper feeding direction, and accordingly, the paper tray 11 can be stably pushed up by the pushing arm 6, thereby effecting a stable supply of copy papers.

As is described hereinabove, in accordance with the arrangement of the third embodiment of the present invention, the paper feeding cassette is set in the paper feeding part of the copying apparatus in the direction crossing at right angles with respect to the paper feeding direction, and at the same time, the pushing arm for pushing up the paper tray within the cassette is stretched in the direction in which the paper feeding cassette is set in the copying apparatus. Moreover, the end portion of the pushing arm is inclined with an angle equal to or larger than the largest rotational angle $\theta$ of the paper tray. Accordingly, the action point of the pushing arm is always positioned at the side of the paper feeding direction, thereby realizing a stable pushing-up of the paper tray and also achieving a secure supply of copy papers by the paper feeding rollers, even in the case where the paper feeding cassette is set in the copying apparatus in the direction orthogonal to the paper feeding direction.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as being included therein.

What is claimed is:

1. A paper feeding device comprising:

a paper feeding cassette detachably inserted in a paper feeding section of a copying apparatus in a direction orthogonal to a paper feeding dircetion of said copying apparatus;

a paper holder tray for placing copy papers thereon, said paper holder tray being mounted rotatably within said paper feeding cassette;

a paper feeding means provided in said paper feeding section for feeding said copy papers from said paper feeding cassette into said copying apparatus;

a pushing arm rotatably mounted in said paper feeding section rotatable in a direction orthogonal to the rotational direction of said paper holder tray, wherein said pushing arm rotation through an opening in said paper feeding cassette pushes said paper holder tray such that said paper holder tray is in a position that allows said paper feeding means to feed paper.

2. A paper feeding device as in claim 1, wherein said paper holder tray is rotatably mounted on a first shaft which is in turn mounted on said paper feeding cassette and wherein said pushing arm is rotatably mounted on a second shaft which is in turn mounted in said paper feeding section below said paper feeding cassette.

3. A paper feeding device as in claim 1, wherein a sliding plate is operatively connected to a spring means which is in turn operatively connected to said pushing arm in said paper feeding section, and wherein said paper feeding cassette engages said sliding plate upon insertion of said paper feeding cassette into said paper feeding section thereby stretching said spring means so as to cause said pushing arm to rotate.

4. A paper feeding device as in claim 1, wherein said pushing arm includes an upper face that inclines at an inclination angle so as to terminate at an action point, said pushing arm contacting said paper holder tray at said action point, and said inclination angle being equal to or greater than the largest rotational angle of said paper holder tray in said paper feeding cassette when said pushing arm pushes said paper holder tray.

5. A paper feeding device as in claim 4, wherein said upper face of said pushing arm further includes a cut off portion which forms a triangular face along one edge of said upper face inclined at an angle equal to or greater than said largest rotational angle of said paper holder tray.

6. A paper feeding device as in claim 4, wherein said pushing arm comprises:

said upper face;

a front face which is orthogonal to said first upper face and adjacent to said first upper face along a first upper edge;

a rear face which is parallel to said front face, orthogonal to said first upper face, and adjacent to said first upper first upper face along a second upper edge;

a first side face which is orthogonal to said front and rear faces, said first side face being adjacent to said front face along a first front side edge and adjacent to said rear face along a first rear side edge;

a second side face which is parallel to said first side face and orthogonal to said front and rear faces, said second side face being adjacent said front face along a second front side edge and adjacent to said rear face along a second rear edge;

wherein said pushing arm further includes a cut off portion which forms a triangular face along said first upper edge, said triangular face comprising (1) a first vertex formed where said upper face, said front face and said first side face meet, (2) a second vertex formed where said upper face, said front face and said second side face meet, and (3) a third vertex formed where said upper face, said rear face and said first side face meet, said triangular face being formed so that the edge formed by said first and third vertexes inclines at an angle equal to or larger than said largest rotational angle of said paper tray holder.

* * * * *